US011313177B2

(12) United States Patent
Grosz

(10) Patent No.: US 11,313,177 B2
(45) Date of Patent: Apr. 26, 2022

(54) COMPLIANT ROLLING ELEMENT RETAINER

(71) Applicant: Halliburton Energy Services, Inc., Houston, TX (US)

(72) Inventor: Gregory C. Grosz, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 23 days.

(21) Appl. No.: 16/961,889

(22) PCT Filed: Feb. 5, 2018

(86) PCT No.: PCT/US2018/016924

§ 371 (c)(1),
(2) Date: Jul. 13, 2020

(87) PCT Pub. No.: WO2019/152057

PCT Pub. Date: Aug. 8, 2019

(65) Prior Publication Data

US 2020/0378190 A1 Dec. 3, 2020

(51) Int. Cl.
*E21B 10/54* (2006.01)
*E21B 10/43* (2006.01)
(Continued)

(52) U.S. Cl.
CPC ..... *E21B 10/54* (2013.01); *E21B 10/14* (2013.01); *E21B 10/20* (2013.01); *E21B 10/43* (2013.01); *E21B 10/62* (2013.01)

(58) Field of Classification Search
CPC ..... E21B 10/43
See application file for complete search history.

(56) References Cited

U.S. PATENT DOCUMENTS 2,238,377 A * 4/1941 Strang ..... E21B 10/34 175/291
2,664,322 A * 12/1953 Boice ..... E21B 10/22 384/92

(Continued)

FOREIGN PATENT DOCUMENTS

WO 2017218000 12/2017
WO 2018017127 1/2018

OTHER PUBLICATIONS

ISRWO International Search Report and Written Opinion for PCT/US2018/016924 dated Oct. 29, 2018.

*Primary Examiner* — Blake Michener
(74) *Attorney, Agent, or Firm* — Thomas Rooney; C. Tumey Law Group PLLC

(57) ABSTRACT

A drill bit is provided that includes a bit body having one or more blades extending therefrom, a plurality of cutters secured to the one or more blades, and a rolling element assembly positioned within a cavity defined on the bit body. The rolling element assembly includes a rolling element rotatable within the cavity about a rotational axis, and a compliant retainer extendable within a retainer slot defined in the cavity to secure the rolling element within the cavity. The compliant retainer and the cavity cooperatively encircle more than 180° but less than 360° of a circumference of the rolling element while leaving a full axial width of the rolling element exposed. The compliant retainer is compressible responsive to forces from the rolling element to absorb vibrations and/or automatically adjust depth of cut.

19 Claims, 6 Drawing Sheets

(51) Int. Cl.

| | |
|---|---|
| ***E21B 10/62*** | (2006.01) |
| ***E21B 10/14*** | (2006.01) |
| ***E21B 10/20*** | (2006.01) |

(56) References Cited

U.S. PATENT DOCUMENTS 4,156,470 A * 5/1979 Bodine ..... B04B 5/10 175/313
4,511,006 A * 4/1985 Grainger ..... B21K 25/00 175/57
4,553,795 A * 11/1985 Takagi ..... B30B 15/028 100/295
4,696,583 A * 9/1987 Gorges ..... B60B 33/08 16/26
6,142,250 A * 11/2000 Griffin ..... E21B 7/068 175/381
8,079,431 B1 * 12/2011 Cooley ..... E21B 10/42 175/432
8,763,727 B1 * 7/2014 Cooley ..... E21B 10/567 175/382
9,187,962 B2 * 11/2015 Burhan ..... E21B 10/573
9,464,486 B2 * 10/2016 Zhang ..... E21B 10/36
9,605,486 B2 * 3/2017 Burhan ..... E21B 10/633
10,458,188 B2 * 10/2019 Bomidi ..... E21B 10/627
10,494,876 B2 * 12/2019 Mayer ..... E21B 17/1092
11,014,759 B2 * 5/2021 Miess ..... B65G 39/025
2007/0079991 A1 * 4/2007 Cooley ..... E21B 10/62 175/57
2010/0212964 A1 * 8/2010 Beuershausen ..... E21B 10/62 175/57
2010/0219001 A1 9/2010 Shen et al.
2014/0326515 A1 11/2014 Shi et al.
2016/0153243 A1 6/2016 Hinz et al.
2019/0040691 A1 * 2/2019 Mayer ..... E21B 12/04
2019/0249498 A1 * 8/2019 Hinz ..... E21B 10/633

* cited by examiner

COMPLIANT ROLLING ELEMENT RETAINER

TECHNICAL FIELD

The present description relates in general to wellbore drilling, and more particularly, for example and without limitation, to a compliant rolling element retainer for a rolling element of a drill bit for wellbore drilling.

BACKGROUND OF THE DISCLOSURE

In conventional wellbore drilling in the oil and gas industry, a drill bit is mounted on the end of a drill string, which may be lengthened by adding segments of drill pipe as the well is progressively drilled to the desired depth. At the surface of the well site, a rotary drive (referred to as a "top drive") may be provided to rotate the entire drill string, including the drill bit at the end, to drill through the subterranean formation. Alternatively, the drill bit may be rotated using a downhole mud motor without having to rotate the drill string. When drilling, drilling fluid is pumped through the drill string and discharged from the drill bit to remove cuttings and debris. The mud motor, if present in the drill string, may be selectively powered using the circulating drilling fluid.

One common type of drill bit used to drill wellbores is a "fixed cutter" bit, wherein the cutters are secured to the bit body at fixed positions. This type of bit is sometimes referred to as a "drag bit" since the cutters in one respect drag rather than roll in contact with the formation during drilling. The bit body may be formed from a high strength material, such as tungsten carbide, steel, or a composite/matrix material. A plurality of cutters (also referred to as cutter elements, cutting elements, or inserts) are attached at selected locations about the bit body. The cutters may include a substrate or support stud made of a carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

In fixed cutter drill bits, PDC cutters are rigidly secured to the bit body, such as by being brazed within corresponding cutter pockets defined on blades that extend from the bit body. Some of the PDC cutters are strategically positioned along the leading edges of the blades to engage the formation during drilling. In use, high forces are exerted on the PDC cutters, particularly in the forward-to-rear direction. Over time, the working surface or cutting edge of each cutter that continuously contacts the formation eventually wears down and/or fails.

The description provided in the background section should not be assumed to be prior art merely because it is mentioned in or associated with the background section. The background section may include information that describes one or more aspects of the subject technology.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1A:
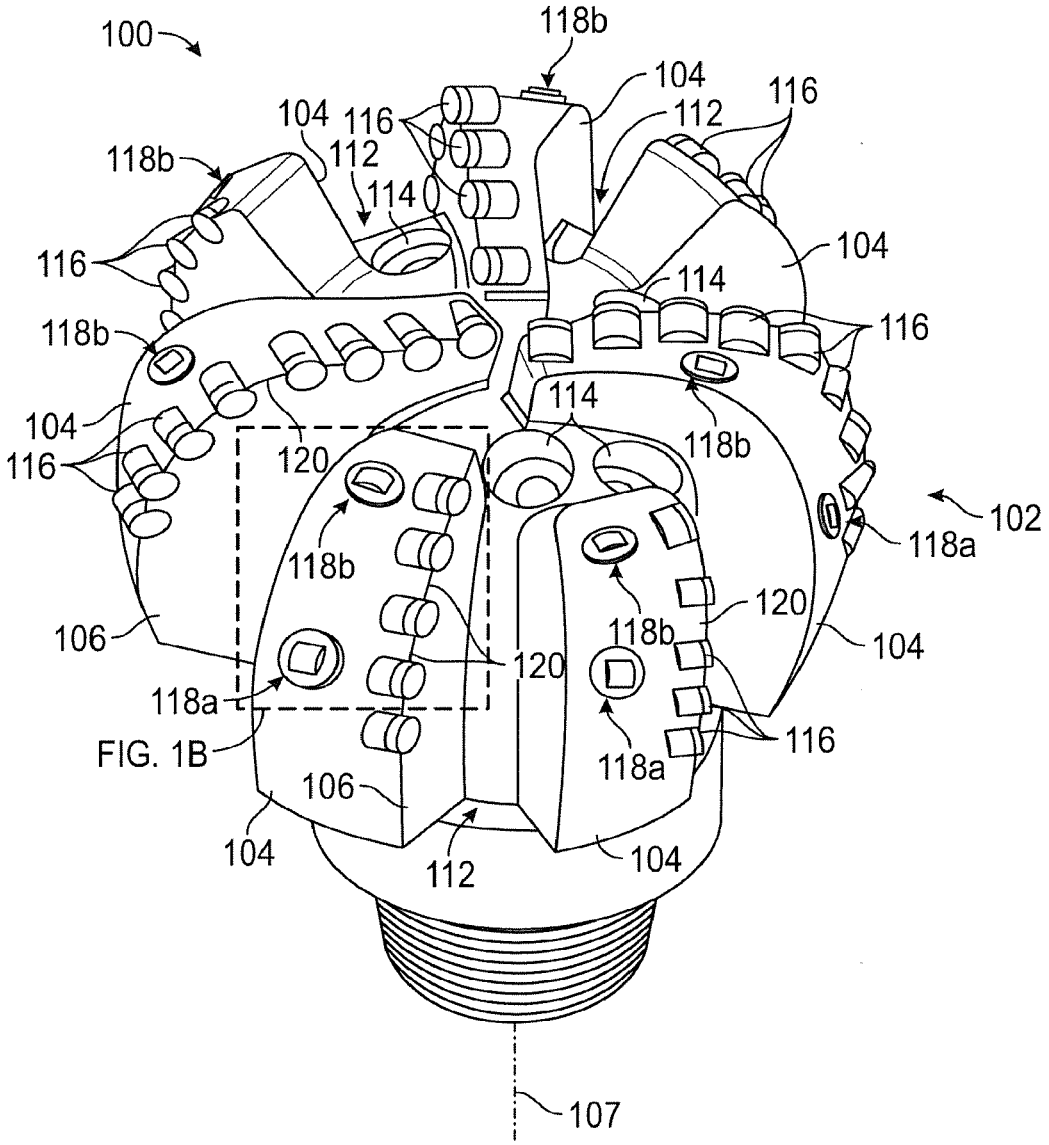
FIG. 1A illustrates an isometric view of a rotary drill bit having a rolling element assembly, in accordance with aspects of the disclosure.

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure relates to earth-penetrating drill bits and, more particularly, to rolling-type depth-of-cut control elements that can be used in drill bits.

Various aspects of the disclosure provide rolling element assemblies that can be secured within corresponding cavities provided on a drill bit. Each rolling element assembly includes a cylindrical rolling element strategically positioned and secured to the drill bit so that the rolling element is able to engage the formation during drilling. In response to drill bit rotation, and depending on the selected positioning and/or orientation of the rolling element with respect to the body of the drill bit, the rolling element may roll against the underlying formation, cut against the formation, or both roll against and cut the formation. The rolling elements of the presently disclosed rolling element assemblies are retained within corresponding cavities on the bit body using a compliant arcuate retainer received within a retainer slot defined in the cavity.

It has been discovered that vibrations during drilling (e.g., drilling using particular combinations of motors and/or bottom hole assemblies (BHAs)) can be transferred from a cylindrical rolling element through an arcuate retainer for the cylindrical rolling element to a securing element for the arcuate retainer. The securing element may be a pin, nail, screw, weld, or other attachment structure that secures the arcuate retainer in the retainer slot. These transferred vibrations can cause the securing element to disengage and/or otherwise release the retainer, which can lead to failure of the rolling element.

In accordance with various aspects of the subject disclosure, a retainer for a cylindrical rolling element of a rolling element assembly is provided. The retainer may be an arcuate structure having a base structure with one or more cavities therein. The cavities increase the compliancy of one or more portions of the retainer or of the entire retainer. The one or more cavities may be filled with compliant material such as an elastomeric material (e.g., a polymer or metallic resilient material). Vibrations on the cylindrical rolling element are dampened by the one or more cavities. In this way, vibrations at the securing element are reduced and/or eliminated, which can increase the lifetime of the rolling element and can prevent rolling element failures that can increase the time and expense of a drilling operation.

Moreover, providing a compliant retainer can allow self-adjustment of the depth-of-cut (DOC) by allowing the position of the cylindrical rolling element to move relative to the bit face by compression or decompression of the compliant retainer.

Rolling element assemblies described herein can be configured as rolling depth of cut control (DOCC) elements that roll along the formation as the drill bit rotates. In a rolling DOCC element configuration, a rolling element may be oriented so that a full axial span of the rolling element bears against the formation. Rolling DOCC elements may exhibit enhanced wear resilience and allow for additional weight-on-bit without negatively affecting torque-on-bit. The compliant retainer can allow small adjustments in the depth-of-cut, responsive to changing loads on the rolling DOCC elements (e.g., due to changing weight-on-bit and/or changing formations during drilling). This may allow a well operator to minimize damage to the drill bit, thereby reducing trips and non-productive time, and decreasing or increasing the aggressiveness of the drill bit without sacrificing its efficiency.

In some example implementations, the rolling element assemblies described herein can be configured as rolling cutting elements. In yet other example implementations, the rolling element assemblies described herein may operate as a hybrid between a rolling cutting element and a rolling DOCC element (e.g., by orienting the rotational axis of the rolling element on a plane that does not pass through the longitudinal axis of the drill bit or through the longitudinal axis of the drill bit). Rolling cutting elements and/or rolling hybrid DOCC cutting elements may exhibit enhanced wear resilience and allow for additional weight-on-bit without negatively affecting torque-on-bit.

FIG. 1A is an isometric view of an exemplary drill bit 100, in accordance with aspects of the present disclosure. In the example of FIG. 1A, drill bit 100 is depicted as a fixed cutter drill bit having rolling element assemblies 118 (denoted 118*a* and 118*b*) that include compliant retainers (not explicitly shown). Fixed cutter drill bit 100 may be implemented as a crystalline diamond compact (PDC) drill bit, a drag bit, a matrix drill bit, and/or a steel body drill bit (as examples). However, it should also be appreciated that rolling element assemblies 118 that include compliant retainers as described herein can be provided in other types of drill bits operable to form a wellbore including, but not limited to, roller cone drill bits, reamers, or other rock removing tools.

Drill bit 100 has a bit body 102 that includes radially and longitudinally extending blades 104 having leading faces 106. Bit body 102 may be made of steel or a matrix of a harder material, such as tungsten carbide. Bit body 102 rotates about a longitudinal drill bit axis 107 to drill into an underlying subterranean formation under an applied weight-on-bit. Corresponding junk slots 112 are defined between circumferentially adjacent blades 104, and a plurality of nozzles or ports 114 can be arranged within junk slots 112 for ejecting drilling fluid that cools drill bit 100 and otherwise flushes away cuttings and debris generated while drilling.

Bit body 102 further includes a plurality of cutters 116 secured within a corresponding plurality of cutter pockets sized and shaped to receive cutters 116. Each cutter 116, in this example, comprises a fixed cutter secured within its corresponding cutter pocket via brazing, threading, shrink-fitting, press-fitting, snap rings, or any combination thereof. Fixed cutters 116 are held in blades 104 and respective cutter pockets at predetermined angular orientations and radial locations to present fixed cutters 116 with a desired back rake angle against the formation being penetrated. As the drill string is rotated, fixed cutters 116 are driven through the rock by the combined forces of the weight-on-bit and the torque experienced at drill bit 100. During drilling, fixed cutters 116 may experience a variety of forces, such as drag forces, axial forces, reactive moment forces, or the like, due to the interaction with the underlying formation being drilled as drill bit 100 rotates.

Each fixed cutter 116 may include a generally cylindrical substrate made of an extremely hard material, such as tungsten carbide, and a cutting face secured to the substrate. The cutting face may include one or more layers of an ultra-hard material, such as polycrystalline diamond, polycrystalline cubic boron nitride, impregnated diamond, etc., which generally forms a cutting edge and the working surface for each fixed cutter 116. The working surface is typically flat or planar, but may also exhibit a curved exposed surface that meets the side surface at a cutting edge.

Generally, each fixed cutter 116 may be manufactured using tungsten carbide as the substrate. While a cylindrical tungsten carbide "blank" can be used as the substrate, which is sufficiently long to act as a mounting stud for the cutting face, the substrate may equally comprise an intermediate layer bonded at another interface to another metallic mounting stud. To form the cutting face, the substrate may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate. When using polycrystalline diamond as the ultra-hard material, fixed cutter 116 may be referred to as a polycrystalline diamond compact cutter or a "PDC cutter," and drill bits made using such PDC fixed cutters 116 are generally known as PDC bits.

As illustrated in FIG. 1A, drill bit 100 may further include a plurality of rolling element assemblies 118, shown as rolling element assemblies 118*a* and 118*b*. The orientation of a rotational axis of each rolling element assembly 118 with respect to a tangent to an outer surface of blade 104 may dictate whether the particular rolling element assembly 118 operates as a rolling DOCC element, a rolling cutting element, or a hybrid of both. As mentioned above, rolling DOCC elements may prove advantageous in allowing for additional weight-on-bit (WOB) to enhance directional drilling applications without over engagement of the fixed cutters 116. Effective DOCC also limits fluctuations in torque and minimizes stick-slip, which can cause damage to fixed cutters 116.

Figure 1B:
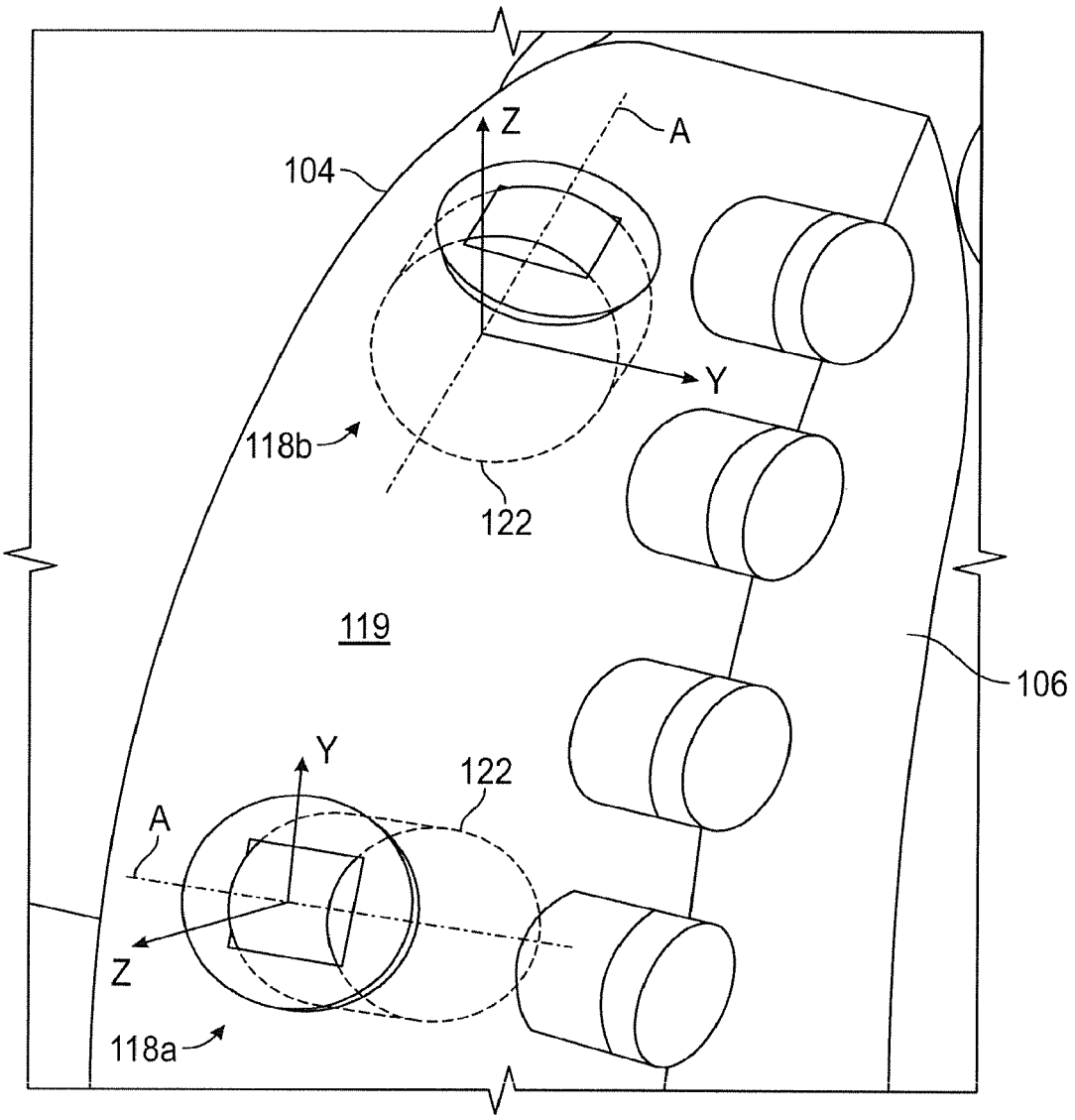
FIG. 1B illustrates an isometric view of a portion of the rotary drill bit enclosed in the indicated box of FIG. 1A, in accordance with aspects of the disclosure.

FIG. 1B is an enlarged portion of drill bit 100 indicated by the dashed box shown in FIG. 1A. As shown in FIG. 1B, each rolling element assembly 118 is located in blade 104 and includes a rolling element 122. Exposed portions of rolling elements 122 are illustrated in solid linetype, while portions of rolling elements 122 that are seated within corresponding housings or pockets of the rolling element assemblies 118 are illustrated in dashed linetype.

Each rolling element 122 has a rotational axis A, a Z-axis that is perpendicular to the blade profile, and a Y-axis that is orthogonal to both the rotational and Z-axes. As shown, the exposed portion of each of rolling elements 122 is constant with respect to the position along the rotational axis of the rolling element, in either the DOCC or the cutter orientation.

If, for example, the rotational axis A of a rolling element 122 is substantially parallel to a tangent to outer surface 119 of the blade profile, that rolling element assembly 118*b* may generally operate as a rolling DOCC element. Said differently, if the rotational axis A of the rolling element 122 passes through or lies on a plane that passes through the longitudinal axis 107 (FIG. 1A) of the drill bit 100 (FIG. 1A), then the rolling element assembly 118*b* may substantially operate as a rolling DOCC element. If, however, the rotational axis A of a rolling element 122 is substantially perpendicular to leading face 106 of the blade 104, then that rolling element assembly 118*a* may substantially operate as a rolling cutting element. Said differently, if the rotational axis A of a rolling element 122 is perpendicular to or lies on a plane that is perpendicular to a plane passing through the longitudinal axis 107 (FIG. 1A) of the drill bit 100 (FIG. 1A), then the rolling element assembly 118*a* may substantially operate as a rolling cutting element.

Accordingly, as depicted in FIG. 1B, rolling element assembly 118*a* may be positioned to operate as a rolling cutting element and rolling element assembly 118*b* may be positioned to operate as a rolling DOCC element. Rolling element assemblies 118 may also be provided in which the rotational axis A of the rolling element 122 lies on a plane that does not pass through the longitudinal axis 107 (FIG. 1A) of the drill bit 100 (FIG. 1A) nor is the plane perpendicular to the longitudinal axis 107, that rolling element assembly 118 operating as a hybrid rolling DOCC and cutting element.

Traditional load-bearing type cutting elements for DOCC can unfavorably affect torque-on-bit (TOB) by simply dragging, sliding, etc. along the formation, whereas a rolling DOCC element, such as rolling element assemblies 118*b*, may reduce the amount of torque needed to drill a formation because it rolls to reduce friction losses typical with load bearing DOCC elements. A rolling DOCC element will also have reduced wear as compared to a traditional bearing element. As will be appreciated, however, one or more of rolling element assemblies 118*b* can also be used as rolling cutting elements, which may increase cutter effectiveness since heat may be distributed more evenly over the entire cutting edge and minimize the formation of localized wear flats on the rolling cutting element.

Referring again to FIG. 1A, rolling element assemblies 118*b* may be placed in the cone region of drill bit 100 and otherwise positioned so that rolling element assemblies 118*b* track in the path of adjacent fixed cutters 116 (e.g., the rolling element assemblies are placed in a secondary row behind the primary row of fixed cutters 116 on blade 104). However, since the second rolling element assemblies 118*b* are able to roll, they can be placed in positions other than the cone without affecting TOB.

Strategic placement of rolling element assemblies 118*a* and 118*b* may further allow the rolling element assemblies to be used as either primary and/or secondary rolling cutting elements as well as rolling DOCC elements, without departing from the scope of the disclosure. For instance, in some implementations, one or more rolling element assemblies 118*a* or 118*b* may be located in a kerf forming region 120 located between adjacent fixed cutters 116. During operation, kerf forming region 120 results in the formation of kerfs on the underlying formation being drilled. One or more of rolling element assemblies 118*a* and 118*b* may be located on the bit body 102 such that they will engage and otherwise extend across one or multiple formed kerfs during drilling operations. In this example, rolling element assemblies 118*a* and/or 118*b* may also function as prefracture elements that roll on top of or otherwise crush the kerf(s) formed on the underlying formation between adjacent fixed cutters 116. In other cases, one or more of rolling element assemblies 118*a* and 118*b* may be positioned on the bit body 102 such that they will proceed between adjacent formed kerfs during drilling operations. In yet other examples, one or more of rolling element assemblies 118*a* and/or 118*b* may be located at or adjacent the apex of drill bit 100 (e.g., at or near longitudinal axis 107). In such examples, drill bit 100 may fracture the underlying formation more efficiently.

Rolling element assemblies 118*a* and 118*b* may be positioned on a respective blade 104 such that rolling element assemblies 118*a* and 118*b* extend orthogonally from the outer surface 119 (FIG. 1B) of the respective blade 104. One or more of rolling element assemblies 118*a* and/or 118*b* may be positioned at a predetermined angular orientation (three degrees of freedom) offset from normal to the profile of the outer surface 119 of the respective blade 104. As a result, rolling element assemblies 118*a* and/or 118*b* may exhibit an altered or desired back rake angle, side rake angle, or a combination of both. As will be appreciated, the desired back rake and side rake angles may be adjusted and otherwise optimized with respect to primary fixed cutters 116 and/or surface 119 (FIG. 1B) of the blade 104 on which the rolling element assemblies 118*a* and/or 118*b* are disposed.

Figure 2:
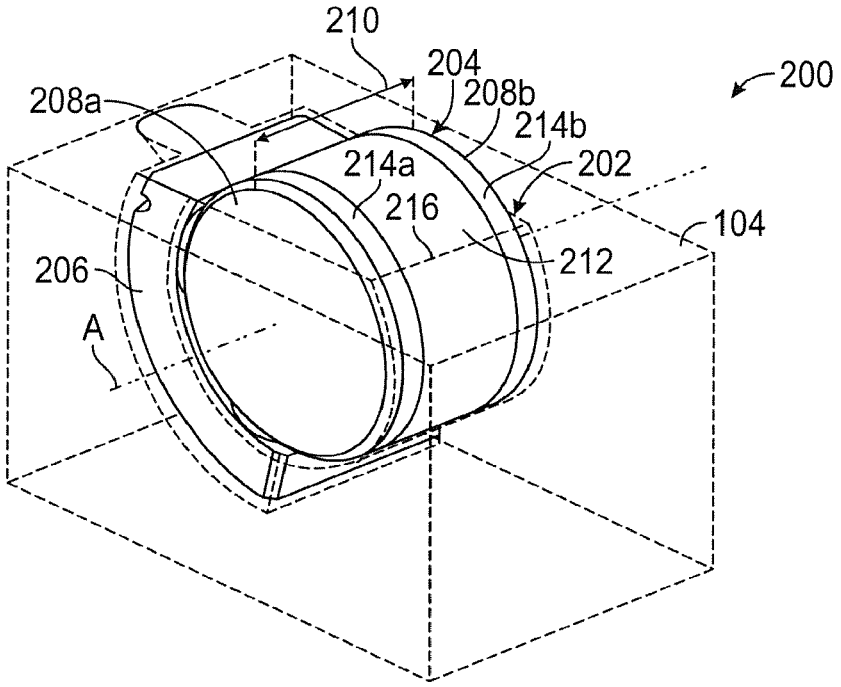
FIG. 2 illustrates an isometric view of one example of a rolling element assembly, in accordance with aspects of the disclosure.

FIG. 2 is an isometric view of one example of a rolling element assembly 200, according to aspects of the disclosure. Rolling element assembly 200 may be, for example, implemented in drill bit 100 of FIGS. 1A-1B. For example, rolling assembly 200 may be an implementation of any of rolling element assemblies 118*a* or 118*b* of FIG. 1A or 1B. As illustrated in FIG. 2, rolling element assembly 200 may be positioned within a cavity 202 defined in blade 104 of drill bit 100. While cavity 202 is shown as being defined in blade 104, it will be appreciated that the principles of the present disclosure are equally applicable to cavity 202 being defined in other locations of drill bit 100, without departing from the scope of the disclosure.

Blade 104 is depicted in FIG. 2 in phantom to allow the component parts of rolling element assembly 200 to be viewed. Moreover, only a portion of blade 104 is represented in FIG. 2 and depicted in the general shape of a cube. In some scenarios, drill bit 100 is made of a matrix material, and cavity 202 may be formed by selectively placing displacement materials (e.g., consolidated sand or graphite) at the location where cavity 202 is to be formed. In other examples, drill bit 100 has a steel body drill bit, and conventional machining techniques may be employed to machine cavity 202 to desired dimensions at the desired location.

Rolling element assembly 200 includes a rolling element 204 that comprises a generally cylindrical or disk-shaped structure having a first axial end 208*a* and a second axial end 208*b* that is opposite the first axial end 208*a*. The distance between first and second axial ends 208*a* and 208*b* is referred to herein as the axial width 210 of the rolling element 204. As shown in the example of FIG. 2, at each position on rolling element 204 between first and second axial ends 208*a* and 208*b* (e.g., at each position along the axial width of rolling element 204), the same amount of rolling element 204 is exposed above the surface of blade 104. However, it should be appreciated that, in some implementations, the axis of rolling element 204 may be non-parallel to the profile of blade 104 such that one end of rolling element 204 is exposed more or less than the other end, depending on the desired bottom hole pattern and configuration.

Rolling element 204 includes a substrate 212 and opposing diamond tables 214*a* and 214*b* arranged at first and second axial ends 208*a* and 208*b*, respectively, and otherwise coupled to opposing axial ends of substrate 212. Substrate 212 may be formed of a variety of hard or ultra-hard materials including, but not limited to, steel, steel alloys, tungsten carbide, cemented carbide, any derivatives thereof, and any combinations thereof. Suitable cemented carbides may contain varying proportions of titanium carbide (TiC), tantalum carbide (TaC), and niobium carbide (NbC). Additionally, various binding metals may be included in substrate 212, such as cobalt, nickel, iron, metal alloys, or mixtures thereof. In substrate 212, the metal carbide grains are supported within a metallic binder, such as cobalt. In other cases, substrate 212 may be formed of a sintered tungsten carbide composite structure or a diamond ultra-hard material, such as polycrystalline diamond (PCD) or thermally stable polycrystalline diamond (TSP).

Diamond tables 214*a* and 214*b* may be made of a variety of ultra-hard materials including, but not limited to, polycrystalline diamond (PCD), thermally stable polycrystalline diamond (TSP), cubic boron nitride, impregnated diamond, nanocrystalline diamond, ultra-nanocrystalline diamond, and zirconia. These hard and/or ultra-hard materials may be suitable for use as bearing surfaces, as herein described.

Rolling element 204 may include one or more cylindrical bearing portions. More particularly, in the example of FIG. 2, the entire rolling element 204 is cylindrical and made of hard, wear-resistant materials, and thus any portion of rolling element 204 may be considered as a cylindrical bearing portion to the extent it slidingly engages a bearing surface of cavity 202 or another component of rolling element assembly 200 when rolling, such as would be expected during drilling operations. In some examples, one or both of diamond tables 214*a* and 214*b* may be considered cylindrical bearing portions for rolling element 204. In other implementations, one or both of diamond tables 214*a* and 214*b* may be omitted from rolling element 204 and substrate 212 may alternatively be considered as a cylindrical bearing portion. In yet other examples, the entire cylindrical or disk-shaped rolling element 204 may be considered as a cylindrical bearing portion and may be made of any of the hard or ultra-hard materials mentioned herein, without departing from the scope of the disclosure. In the example of FIG. 2, the bearing surface of rolling element 204 is a smoothly contiguous surface that is free of grooves or protrusions thereon, to help facilitate smooth rotation of that bearing surface against the bearing surface of cavity 202. The bearing surface of cavity 202 is similarly smoothly contiguous and free of protrusions or grooves.

It should be noted that the features of rolling element 204 are shown for illustrative purposes only and may or may not be drawn to scale. For example, the thickness or axial extent of both diamond tables 214*a* and 214*b* may or may not be the same. In at least one example, one of diamond tables 214*a* and 214*b* may be thicker than the other. Moreover, in some examples, one of diamond tables 214*a* or 214*b* may be omitted from rolling element 204 altogether. In yet other examples, substrate 212 may be omitted and rolling element 204 may instead be made entirely of the material of diamond tables 214*a* and 214*b*.

Rolling element assembly 200 also includes a retainer 206 configured to help secure or retain rolling element 204 in cavity 202 (e.g., during use). More particularly, cavity 202 provides and otherwise defines an opening 216 large enough to receive rolling element 204. When seated within cavity 202, an arcuate portion of rolling element 204 extends out of cavity 202 to expose the full axial width 210 of that portion of rolling element 204.

Retainer 206 is a compliant retainer that includes one or more compliant portions or that has an overall compliancy. Compliant retainer 206 may subsequently be inserted into cavity 202 so that cavity 202 and retainer 206 cooperatively retain rolling element 204 within cavity 202. Cooperatively retaining rolling element 204 within cavity 202 is accomplished as portions of cavity 202 and retainer 206 jointly encircle more than 180° of the circumference of rolling element 204, but less than 360°, so that the full axial width 210 of a portion of rolling element 204 remains exposed for external contact with a formation during drilling operations.

Retainer 206 may be provided with compliancy at one or more locations thereon by providing one or more internal voids or cavities therein. The internal cavities may be evacuated, air-filled, gas-filled, or filled with a compliant material such as an elastomer or a low modulus metal capable of withstanding downhole conditions. One or more materials having differing moduli of elasticity may be used to form the base structure of retainer 206 and to fill one or more cavities in the base structure to provide a retainer having a desired compliancy at one or more locations thereon. The amount of the arcuate portion of rolling element 204 that extends out of cavity 202 to expose the full axial width 210 that portion may vary based on the compressive state of retainer 206 (e.g., due to varying amounts of compression of compliant retainer 206).

During drilling operations, rolling element 204 is able to rotate within cavity 202 about a rotational axis A of rolling element 204. As rolling element 204 rotates about the rotational axis A, the arcuate portion of rolling element 204 extending out of cavity 202 and otherwise exposed through opening 216 engages (e.g., cuts, rolls against, or both) the underlying formation. This rotation allows the full axial width 210 of rolling element 204, across the entire outer circumferential surface, to progressively be used to engage the formation as rolling element 204 rotates during use. In configurations in which the amount of rolling element 204 that is exposed is constant across the axial width, the wear on the outer surface of rolling element 204 is uniform across the axial width.

Figure 3:
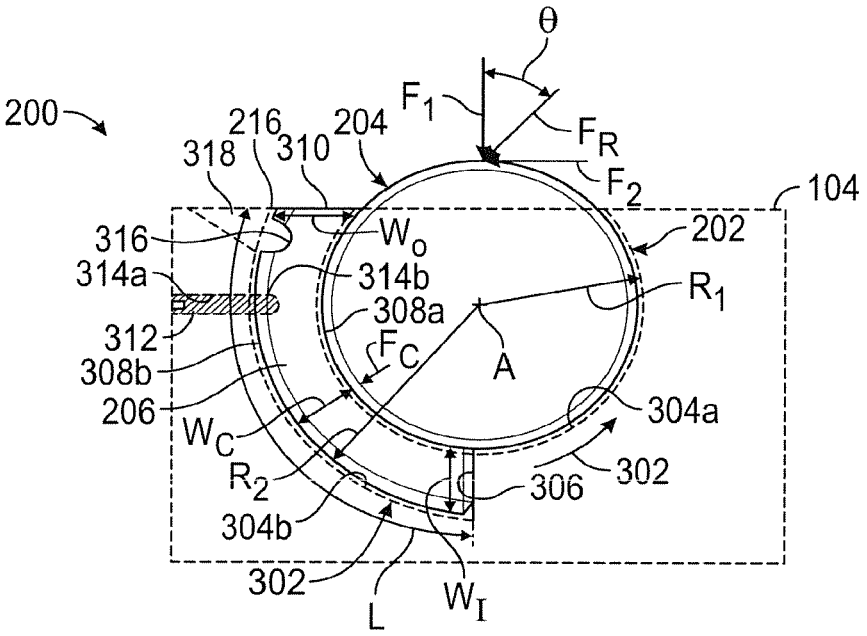
FIG. 3 illustrates a side view of the rolling element assembly of FIG. 2, in accordance with aspects of the disclosure.

FIG. 3 is a side view of rolling element assembly 200 as installed within the cavity 202 defined in blade 104. Again, blade 104 is depicted in FIG. 3 in phantom to allow the component parts of rolling element assembly 200 to be viewed, and only a portion of blade 104 is represented in FIG. 2 and depicted in the general shape of a cube. Retainer 206 is shown in FIGS. 2 and 3 receiving rolling element 204 to rotatably secure the rolling element about rotational axis A of the rolling element.

As illustrated, cavity 202 includes a retainer slot 302 configured to receive and seat retainer 206. More specifically, cavity 202 may provide a first arcuate portion 304*a* that extends from one side of opening 216 and a second arcuate portion 304*b* that extends from the opposing side of opening 216. The first arcuate portion 304*a* has a first radius $R_1$ and second arcuate portion 304*b* has a second radius $R_2$ that is greater than first radius $R_1$ End wall 306 provides a transition between first and second arcuate portions 304*a* and 304*b*. With a larger second radius $R_2$, second arcuate portion 304*b* is sized to accommodate retainer 206 within cavity 202. Accordingly, retainer slot 302 is defined, at least in part, by second arcuate portion 304*b* and end wall 306.

Retainer 206 includes an inner arcuate surface 308*a* and an outer arcuate surface 308*b* opposite inner arcuate surface 308*a*. When retainer 206 is disposed within retainer slot 302, outer arcuate surface 308*b* will be disposed against or otherwise adjacent second arcuate portion 304*b* and inner arcuate surface 308*a* will be disposed against or otherwise adjacent the outer circumferential surface of rolling element 204. Moreover, compliant retainer 206 is sized such that the curvature of first arcuate portion 304*a* will transition smoothly to the curvature of inner arcuate surface 308*a*, at least when retainer 206 is uncompressed, to enable rolling element 204 to bear against a continuously (uniformly) curved surface at all angular locations within cavity 202 during operation. In the example of FIG. 3, arcuate surface 308*a* is smoothly contiguous (e.g., free of protrusions or grooves) to provide a uniform surface for rotation of rolling element 204 against surface 308*a*.

As shown in FIG. 3, retainer 206 has a radial thickness defined by an interior thickness $W_I$ (e.g., the distance between surfaces 308*a* and 308*b* at an inner edge of retainer 206 that is configured to be disposed adjacent to end wall 306), an outer thickness $W_O$ (e.g., the distance between surfaces 308*a* and 308*b* at an outer edge 310 that is configured to be disposed parallel to the outer surface blade 104), and a central thickness $W_C$ (e.g., the distance between surfaces 308*a* and 308*b* at a location between the inner and outer edges).

In an uncompressed configuration in which retainer 206 is free of external forces, inner thickness $W_I$, outer thickness $W_O$, and central thickness $W_I$ may be the same. However, a force $F_C$ on surface 308*a* of retainer 206 (e.g., a force provided by the surface of rolling element 204) may compress one or more portions of retainer 206. For example, in operation, a force $F_R$ provided on rolling element 204 by the formation can cause rolling element 204 to press into surface 308*a* with force $F_C$. As described in further detail hereinafter (see, e.g., FIGS. 5-11 and the associated description), one or more interior cavities may be arranged within retainer 206 to provide the desired compliancy at the desired locations.

Retainer 206 may be secured within cavity 202 (e.g., retainer slot 302) using a variety securing features or attachment structures such as, but not limited to, brazes, welds, an industrial adhesive, a press-fit, a shrink-fit, one or more mechanical fasteners (e.g., screws, bolts, snap rings, pins, a ball bearing retention mechanism, a locking wire, etc.), or any combination thereof. In at least one example, as illustrated in FIG. 3, a set screw 312 (shown in dashed lines in FIG. 3) or the like may be used to secure retainer 206 within retainer slot 302. In the illustrated example, set screw 312 may be extended through a hole 314*a* defined in blade 104, such as a trailing face of blade 104, and threaded into a correspondingly aligned hole 314*b* defined in retainer 206. It will be appreciated, however, that set screw 312 may be used to secure retainer 206 within retainer slot 302 via alternately defined holes provided in other locations, without departing from the scope of the disclosure.

If care is not taken, vibrations of rolling element 204 can be transferred to screw 312 or other attachment structures. These vibrations can cause screw 312 to back out of hole 314*b* or can cause other securing elements or attachment structures to become unsecured or to break down (e.g., in the case of a weld, braze, or other securement material). Compliant retainer 206 is arranged to absorb some or all of these vibrations (e.g., at desired frequencies) to prevent the vibrations from being transferred to screw 312.

Rolling element assembly 200 may be arranged on blade 104 such that rolling element 204 will rotate about the rotational axis A in a first direction 320 during operation. As rolling element 204 engages an underlying subterranean formation and rotates about the rotational axis A, weight on bit (WOB) force $F_1$ and friction force $F_2$ will act on rolling element 204. WOB force $F_1$ is the weight force applied to rolling element 204 in the direction of advancement of drill bit 100 (FIGS. 1A-1B). Friction force $F_2$ is a drag force assumed by rolling element 204 and applied in the direction opposite rotation of drill bit 100. Based on the respective magnitudes of WOB force $F_1$ and friction force $F_2$, a resultant force $F_R$ will be assumed by rolling element 204. The magnitude of the resultant force $F_R$ may be determined as follows:

$$F_R^2 = F_1^2 + F_2^2 \qquad \text{Equation (1)}$$

The resultant force $F_R$ vector will be directed at an angle θ offset from the WOB force $F_1$. The angle θ may be determined as follows:

$$\theta = \arctan\frac{F_2}{F_1} \qquad \text{Equation (2)}$$

If the direction of the resultant force $F_R$ vector intersects retainer 206 as positioned within retainer slot 302, then retainer 206 helps retains rolling element 204 in cavity 202 and acts as a bearing element that assumes at least a portion $F_C$ of the resultant force $F_R$ of rolling element 204 during drilling operations In the example of FIG. 3, an arc length L of retainer 206 is long enough that the resultant force $F_R$ vector will intersect retainer 206, which allows retainer 206 to operate as a retaining structure and a bearing element that receives force $F_C$ from rolling element 204. Moreover, because of the arcuate shape of the retainer 206, the maximum arc length L may be limited to the size of opening 216.

Accordingly, compliant retainer 206 not only helps secure rolling element 204 in cavity 202, but can also serve as a compliant bearing surface that supports and guides rolling element 204, may assume most (if not all) of the load exerted on rolling element 204, absorbs vibrations from rolling element 204, and/or allows variations in the position of rolling element 204 in cavity 202 responsive to the force $F_R$ on rolling element 204. In contrast, first arcuate surface 304*a* may see only minimal loads under normal operation conditions. Given the design of rolling element assembly 200, the force exerted on retainer 206 during operation may be primarily compressive in nature. Surface 308*a* of retainer 206 may be made of a hard or ultra-hard material to help reduce the amount of friction and wear between rolling element 204 and retainer 206 as rolling element 204 bears and slides against inner arcuate surface 308*a*.

However, as noted above, at least some portions of retainer 206 may be compliant or compressible portions such that force $F_C$ on surface 308*a* of retainer 206 (e.g., a force provided by the surface of rolling element 204) can compress one or more portions of retainer 206. For example, in operation, force $F_R$ on rolling element 204 by the formation can cause rolling element 204 to press into surface 308*a* with force $F_c$. Force $F_c$ can cause deformation of retainer 206 such that central thickness $W_e$ is reduced (e.g., by movement of surface 308*a* toward surface 308*b* due to pressure from 204 responsive to weight on bit (WOB) force $F_1$ and friction force $F_2$ acting on rolling element 204). In this way, changes in the force $F_R$ cause compression or extension of compliant retainer 206 such that compliant retainer 206 absorbs vibrations and/or allows automatic adjustment of the DOC.

Outer thickness $W_O$ and/or inner thickness $W_I$ of retainer 206 can also be reduced by a compressive force exerted by rolling element 204. However to avoid wear at the interface between edge wall 306 and surface 304*a*, in some implementations, compliant retainer 206 may have an inner edge wall at the inner edge portion thereof that is rigid and incompressible or relatively less compliant that other portions of retainer 206 (e.g., such that inner thickness $W_1$ does not decrease when thicknesses $W_O$ and/or $W_C$ are reduced by compression).

The example of FIG. 3 also shows how retainer 206 may include an extraction feature 316 used to help extract retainer 206 from cavity 202 when desired. Extraction feature 316 may comprise any negative or positive alteration in the geometrical shape of retainer 206 that provides a location where retainer 206 may be gripped or otherwise engaged to pry (rotate) retainer 206 out of retainer slot 302. When it is desired to remove retainer 206 from cavity 202, a user may access and engage extraction feature 316 with a rigid contrivance (e.g., a pick, a screwdriver, a rigid rod, etc.) and pry (rotate) compliant retainer 206 out of retainer slot 302. In at least one example, as illustrated, an access groove 318 may be defined in the upper surface of blade 104 to provide a location where a user can access extraction feature 316 and gain leverage over compliant retainer 206 to pry it out of cavity 202. In the example of FIG. 3, access groove 318 is formed in the upper surface of blade 104 adjacent outer arcuate surface 308*b* of retainer 206. In other examples, access groove 318 can be formed in the upper surface of blade 104 adjacent one or both of the sidewalls of retainer 206. In implementations in which retainer 206 is brazed into cavity 202, the braze may first be melted prior to extracting retainer 206.

It should be noted that, although rolling element assembly 200 has been described as retaining one rolling element 204, rolling element assembly 200 (or any of the rolling element assemblies described herein) may include two or more rolling elements 204, without departing from the scope of the disclosure. In multiple rolling element implementations, the multiple rolling elements 204 may be retained within cavity 202 using a single retainer 206 or each rolling element 204 may be supported by an individual retainer 206.

Figure 4A:
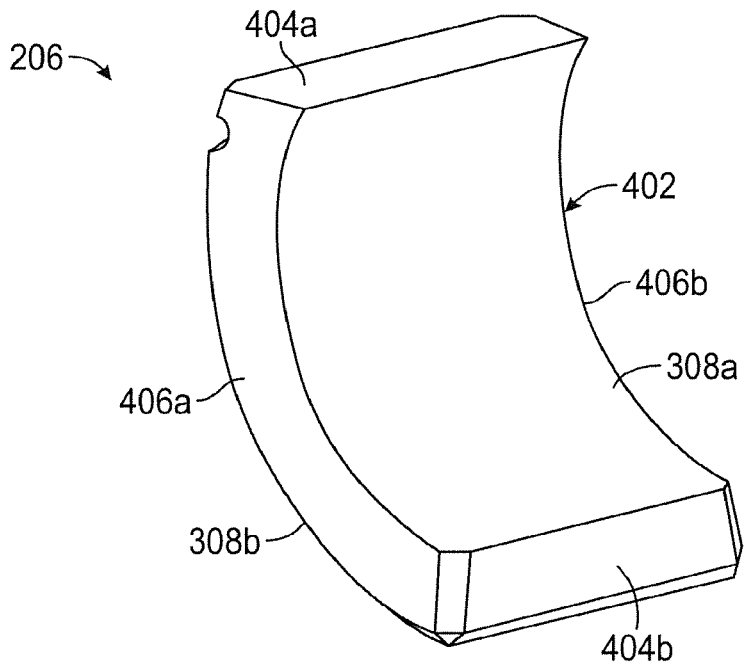
FIGS. 4A and 4B are isometric an end views, respectively, of an example implementation of the retainer of FIGS. 2 and 3, in accordance with aspects of the disclosure.
Figure 4B:
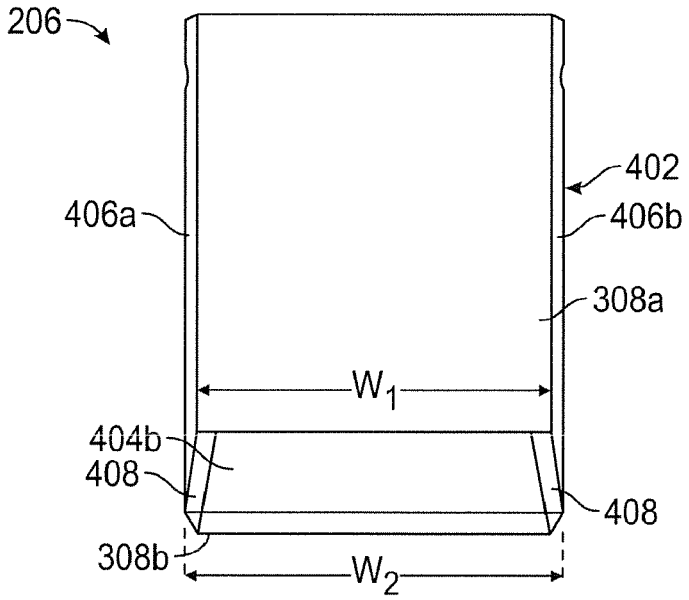
Figure 10:
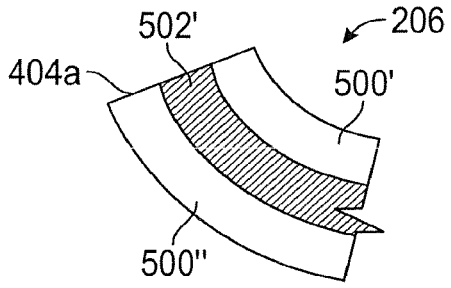
FIG. 10 illustrates a cross-sectional side view of a portion of another exemplary compliant retainer, in accordance with aspects of the disclosure.
Figure 11:
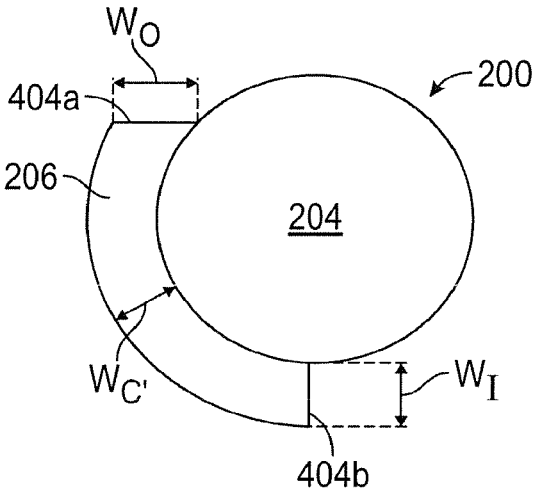
FIG. 11 illustrates a side view of a rolling element assembly in which a compliant retainer is being compressed by a rolling element of the rolling element assembly, in accordance with aspects of the disclosure.

FIGS. 4A and 4B show exterior features of compliant retainer 206. FIGS. 5-10 show cross-sectional views of compliant retainer 206 so that various configurations of the compliant features of retainer 206 can be seen. FIG. 11 shows an exemplary compressed configuration for retainer 206.

FIGS. 4A and 4B are isometric and end views, respectively, of an example implementation of compliant retainer 206. As illustrated in FIG. 4A, retainer 206 may include a generally arcuate base structure 402 having a first end 404*a*, a second end 404*b*, inner arcuate surface 308*a*, outer arcuate surface 308*b*, a first sidewall 406*a*, and a second sidewall 406*b*. The inner and outer arcuate surfaces 308*a* and 308*b* extend between the first and second ends 404*a* and 404*b*. Second end 404*b* may be configured to engage or come into close contact with end wall 306 (FIG. 3) when the retainer 206 is inserted into the retainer slot 302 (FIG. 3). The first and second sidewalls 406*a* and 406*b* extend radially between the inner and outer arcuate surfaces 308*a* and 308*b* on each axial end of the retainer 206.

In some examples, as shown in FIG. 4B, some or all of the base structure 402 of the retainer 206 may exhibit a polygonally symmetric cross-sectional shape. As used herein, the term "polygonally-symmetric" refers to a cross-sectional shape that is polygonal and symmetric on both axial sides of the shape. In the example of FIGS. 4A and 4B, retainer 206 exhibits a generally dovetail cross-sectional outer shape. More particularly, inner arcuate surface 308*a* may, in an uncompressed configuration, exhibit a first width $W_1$ and outer arcuate surface 308*b* may exhibit a second width $W_2$ greater than the first width $W_1$. Accordingly, sidewalls 406*a* and 406*b* may taper inward as extending radially from outer arcuate surface 308*b* to inner arcuate surface 308*a*. In examples in which retainer 206 is brazed into retainer slot 302 (FIG. 3), the tapered sidewalls 406*a* and 406*b* may prove advantageous in helping prevent retainer 206 from shifting out of retainer slot 302 during the brazing process. It will be appreciated, however, that other polygonally-symmetric cross-sectional shapes may also be employed, such as a T-shaped base structure 402, without departing from the scope of the disclosure. Moreover, some or all of base structure 402 of retainer 206 may alternatively exhibit rounded features or polygonally asymmetric cross-sectional shape, as discussed in more detail below.

In some examples, transition corners 408 between second end 404*b* and the first and second sidewalls 406*a* and 406*b* and of retainer 206 may be chamfered or radiused. Chamfered or radiused transition corners 408 may help with ease of installation of the retainer into retainer slot 302 (FIG. 3). In other examples, however, transition corners 408 may be angled, such as including a 90° (or substantially 90°) transition between second end 404*b* and first and second sidewalls 406*a* and 406*b* of retainer 206, without departing from the scope of the disclosure.

Figure 5:
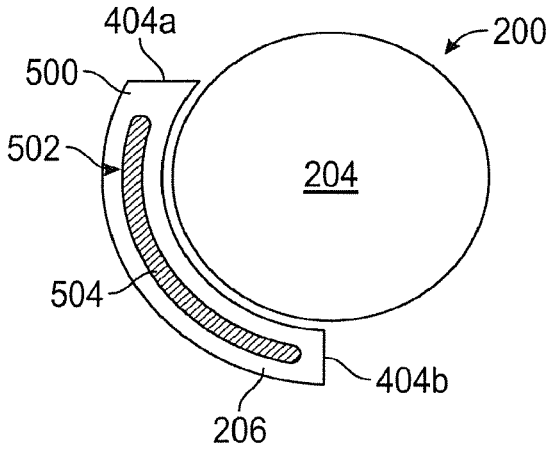
FIG. 5 illustrates a cross-sectional side view of a rolling element assembly having an exemplary compliant retainer, in accordance with aspects of the disclosure.

FIG. 5 shows a cross-sectional side view of rolling element assembly 200. As shown in FIG. 4, compliant retainer 206 may be provided with a base structure 500 (e.g., an implementation of base structure 402) having an internal cavity 502. Under a compressive force from rolling element 204, a portion of rigid base structure 500 can be pressed into cavity 502, responsive to a force on the inner arcuate surface, to provide compliancy for the compliant retainer by a reduction in size or other deformation of the cavity.

Base structure 500 of retainer 206 can be formed from any combination of the hard or ultra-hard materials described above for the substrate 212 and the diamond tables 214*a* and 214*b*. More specifically, base structure 500 may include one or more materials such as, but not limited to, steel, a steel alloy, tungsten carbide, a sintered tungsten carbide composite structure, cemented carbide, polycrystalline diamond (PCD), thermally stable polycrystalline diamond (TSP), cubic boron nitride, impregnated diamond, nanocrystalline diamond, ultra-nanocrystalline diamond, zirconia, any derivatives thereof, and any combinations thereof. Alternatively, or in addition thereto, the retainer 206 may be made of an engineering metal, a coated material (i.e., using processes such as chemical vapor deposition, plasma vapor deposition, etc.), or other hard or abrasion-resistant materials. Base structure 500 may be formed from a hard material with an ultra-hard material on the bearing surface thereof (e.g., to form a hard faced region). The materials for base structure 500 are selected to provide a tough ductile material with a hard faced region, to provide the desired bearing resistance while still allowing the toughness of the retainer substrate.

A base structure 500 formed from or having an inner surface formed from a hard or ultra-hard material may help reduce the amount of friction and wear between rolling element 204 and retainer 206 as rolling element 204 bears and slides against inner arcuate surface 308*a*. Hard or ultra-hard materials of base structure 500 may reduce or eliminate the need for lubrication between retainer 206 and rolling element 204. Inner arcuate surface 308*a* may be polished so as to further reduce friction between the opposing surfaces, if desired. Inner arcuate surface 308*a* may be polished, for example, to a surface finish of about 40 micro-inches or better.

As rolling element 204 rotates in first direction 320, element 204 urges retainer 206 to remain secured in cavity 202. More particularly, friction generated between the outer circumference of rolling element 204 and inner arcuate surface 308*a* of retainer 206 will continuously provide a force that urges retainer 206 against end wall 306 and otherwise deeper into cavity 202.

In the example of FIG. 5, cavity 502 is filled with an elastomeric material 504. Elastomeric material 504 can be a polymer material or a relatively more elastic metal (e.g., a low modulus metal capable of withstanding downhole conditions) than that of base structure 500. However, it should be appreciated that providing elastomeric material 504 in cavity 502 is merely illustrative. In some implementations, cavity 502 may be an air-filled cavity, a cavity filled with another desired gas or fluid, or can be an evacuated cavity.

Retainer 206, having an internal cavity 502 in a base structure 500, may be formed in a molding, casting, investment casting, additive manufacturing (e.g., 3-dimensional (3D) printing) or other suitable manufacturing process. Base structure 500 may be a monolithic base structure or may be formed from multiple pieces (e.g., two interfacing pieces, each having a recess that, together, form an interior cavity when the two interfacing pieces are attached together).

In the example of FIG. 5, base structure 500 is provided with a single internal cavity 502 that extends, equidistant from inner and outer surfaces 308*a* and 308*b* in a circumferential direction between edges 404*a* and 404*b*, with a portion of base structure 500 separating cavity 502 from each of outer surfaces 308*a* and 308*b* and edges 404*a* and 404*b*. In the example of FIG. 5, cavity 502 has a constant width and a constant thickness progressing along the length in a direction between edges 404*a* and 404*b*. However, it should be appreciated that the single, constant-width, constant-thickness, centered cavity 502 of FIG. 5 is merely illustrative and that other arrangements are contemplated (e.g., multiple cavities, varying width cavities, varying thickness cavities, varying length cavities, and/or varying location cavities).

Figure 6:
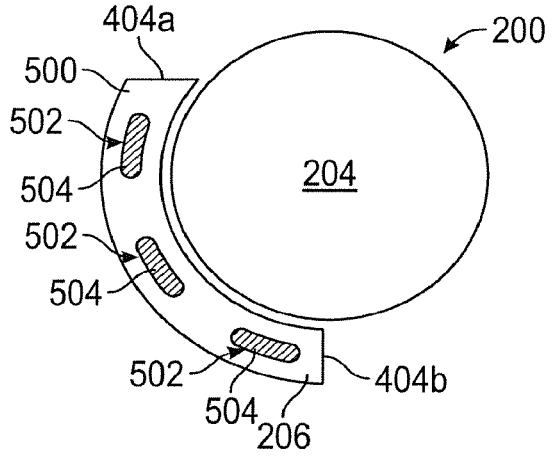
FIG. 6 illustrates a cross-sectional side view of a rolling element assembly having another exemplary compliant retainer, in accordance with aspects of the disclosure.

For example, FIG. 6 shows an example in which base structure 500 includes multiple cavities 502. Some or all of cavities 502 may be filled with elastomeric material 504. In one example, each of cavities 502 is filled with a common material 504. In other examples, some of cavities 502 may be free of material 504 and/or some of cavities 502 are provided with a different elastomeric material (e.g., to provide varying degrees of compressibility at various locations on retainer 206.

Figure 7:
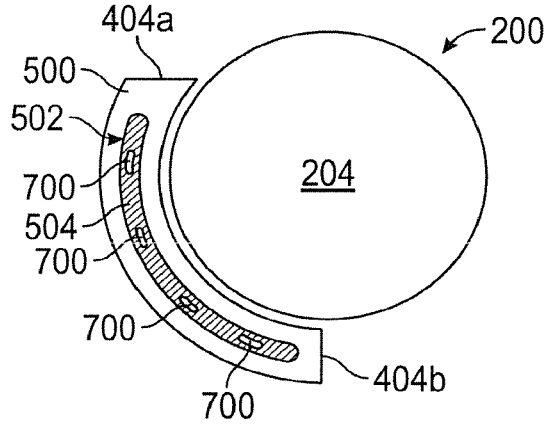
FIG. 7 illustrates a cross-sectional side view of a rolling element assembly having another exemplary compliant retainer, in accordance with aspects of the disclosure.

In the examples of FIGS. 5 and 6, material 504 substantially fills the cavity(ies) in which it is disposed. However, FIG. 7 shows another example in which voids 700 are provided at various locations within material 504 in cavity 502. The shapes and positions of voids 700 can be arranged to provide a desired (e.g., varying) compressibility at various locations on retainer 206.

Figure 8:
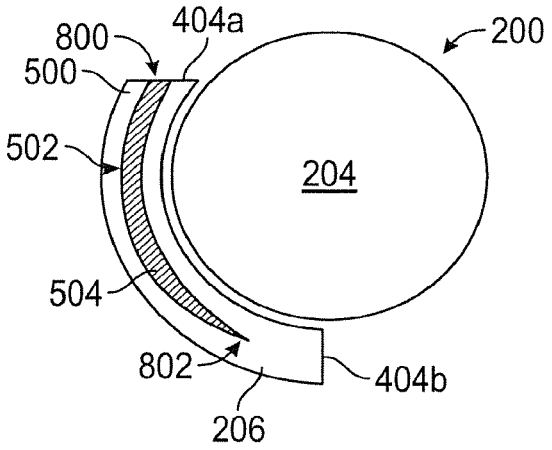
FIG. 8 illustrates a cross-sectional side view of a rolling element assembly having another exemplary compliant retainer, in accordance with aspects of the disclosure.

In the examples of FIGS. 5-7, cavity 502 is a closed cavity that is entirely encapsulated by base structure 500. However, as shown in FIG. 8, cavity 502 can extend to one or more of edges 404*a* or 404*b*. In the example of FIG. 8, cavity 502 extends to outer edge 404*a* of retainer 206 and includes a taper portion 802 that tapers in the direction of inner edge 404*b*. In this example, the apex of tapered portion 802 is separated from inner edge 402*b* by a portion of base structure 500. In this way, retainer 206 may be arranged to be compressible at the location of center thickness $W_C$ and have a compressible outer edge 800, while inner edge 404*a* is substantially incompressible so that inner thickness $W_1$ does not change, even in the presence of force $F_C$ on retainer 206.

In the example of FIG. 8, compliant retainer 206 may be increasingly compressible at locations that are circumferentially further from inner edge 404*b* so that outer thickness $W_O$ is reduced more than central thickness $W_C$, which is reduced more than inner thickness $W_1$ which may be the thickness of an incompressible inner edge wall at edge 404*a* (e.g., incompressible relative to other portions of retainer 206). In this configuration, increased forces $F_R$ from the formation on rolling element 204 cause rolling element 204 to be moved into cavity 202 and also laterally within opening 216, reducing the size of opening 216. As shown in FIG. 8, a tapered cavity 502 and/or a cavity extending to the edge of base structure 500 can be filled with elastomeric material 504, if desired.

As noted above, base structure 500 and cavity(ies) 502 can be formed from any of various manufacturing processes including, for example, an additive manufacturing process (e.g., a 3D printing process). Forming retainer 206 using additive processes such as 3D printing processes can facilitate more complex shapes for cavity 502. For example, FIG. 9 shows a configuration of retainer 206 in which cavity 502 is an undulating cavity having a substantially constant thickness progressing circumferentially between edges 404*a* and 404*b*, but with a varying distance from inner and outer arcuate surfaces 308*a* and 308*b*.

In this way, a compressible retainer 206 can be provided with a desired spring constant and/or other resiliency features such as a location-dependent compressibility and/or a formation-specific compressibility. A location-dependent compressibility can include a compressibility at each location on surface 308*a* that is tuned to a desired spring constant (e.g., a location-dependent spring constant) for that location (e.g., to control where vibrations are primarily absorbed and transferred within retainer 206 and/or to control the motion of rolling element 204 into cavity 202 due to the compression of retainer 206). A formation-specific compressibility may be a compressibility (e.g., an overall compressibility or a location-dependent compressibility) that is tuned to the particular formation to be drilled or to a particular wellbore drilling environment.

Figure 9:
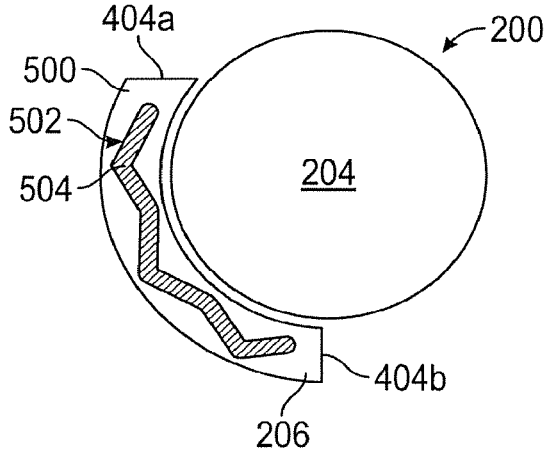
FIG. 9 illustrates a cross-sectional side view of a rolling element assembly having another exemplary compliant retainer, in accordance with aspects of the disclosure.

In the example of FIG. 9, cavity 502 is a single contiguous undulating closed cavity with regular undulations progressing in a direction between edges 404*a* and 404*b*. However, it should be appreciated that other arrangements of cavity 502 can be provided, including but not limited to undulations progressing between sidewalls 406*a* and 406*b*, irregular undulations, broken undulations (e.g., in a discontinuous set of cavities), or non-undulating cavities shaped to provide a desired overall and/or location-dependent compliancy for retainer 206. As shown in FIG. 9, a shaped cavity such as an undulating cavity can be filled with elastomeric material 504, if desired.

In the examples of FIGS. 5-9, base structure 500 is a contiguous base structure with one or more internal cavities. However, as shown in FIG. 10, in some implementations, compliant retainer 206 can be formed from an inner rigid structure 500' and an outer rigid structure 500" with a compliant structure 502' disposed between inner rigid structure 500' and outer rigid structure 500". Inner rigid structure 500' and outer rigid structure 500" can be formed from the same material or different materials such as any of the materials described above in connection with base structure 500. Compliant structure 502' may be formed from any of the elastomeric or resilient materials described above in connection with elastomeric material 504.

In the example of FIG. 10, the inner surface of inner rigid member 500' forms inner arcuate surface 308*a* of retainer 206 and the outer surface of outer rigid member 500" forms the outer surface 308*b* of retainer 206. In this example, compliant member 502' extends from outer edge 404*a* to inner edge 404*b* of retainer 206.

For illustrative purposes, the compliancy of retainer 206 is reflected in the side-view example of FIG. 11 in which center thickness $W_C$ has been reduced to a reduced center thickness $W_C$. In the example of FIG. 11, outer thickness $W_O$ and inner thickness $W_1$ are unchanged and inner surface 308*a* of retainer 206 has deformed and moved toward outer surface 308*b* responsive to the force being applied by rolling element 204. However, it should be appreciated that, depending on the direction and magnitude of the force applied by rolling element 204, and the arrangement of compliancy features (e.g., cavities and/or elastomeric materials) within retainer 206, any or all of thicknesses $W_O$, $W_I$, or $W_C$ may be compressed by the force from rolling element 204.

In some implementations, one or more depressions (not shown) may be defined in inner arcuate surface 308*a* of retainer 206 to retain and otherwise receive a hardfacing material, which may prove advantageous in increasing the abrasion, erosion, and/or corrosion resistance of the inner arcuate surface 308*a* of the retainer 206.

One suitable hardfacing material comprises sintered tungsten carbide particles in a steel alloy matrix. The tungsten carbide particles may include grains of monotungsten carbide, ditungsten carbide and/or macrocrystalline tungsten carbide. Spherical cast tungsten carbide may typically be formed with no binding material. Examples of binding materials used to form tungsten carbide particles may include, but are not limited to, cobalt, nickel, boron, molybdenum, niobium, chromium, iron and alloys of these elements. Other hard constituent materials include cast or sintered carbides consisting of chromium, molybdenum, niobium, tantalum, titanium, vanadium and alloys and mixtures thereof.

In some implementations, one or more material recesses (not shown) may be defined or otherwise provided on outer arcuate surface 308*b* of retainer 206. The outer surface recesses may be used to retain a locking material (e.g., braze paste, solder, etc.) used to secure retainer 206 within cavity 202 (see, e.g., FIGS. 2 and 3).

Although rolling element 204 described above in connection with, for example, FIGS. 2 and 3 includes a constant diameter progressing axially thereacross, in some implementations, rolling element 204 may exhibit a variable diameter between the axial ends and along the axial width thereof. More specifically, the outer surface of the rolling element may be curved, rounded, or otherwise arcuate while maintaining a smooth contiguous profile across the axial width (e.g., free of circumferential or axial protrusions or grooves) such that the exposed portion of the rolling element is constant at least at first and second axial ends 208*a* and 208*b*. Compliant retainer 206 may have, in an uncompressed configuration, an arcuate, smooth, contiguous surface 308*a* that conforms and is complementary to any of these cylindrical profiles for rolling element 204.

Various examples of aspects of the disclosure are described below as clauses for convenience. These are provided as examples, and do not limit the subject technology.

Clause A. A drill bit, comprising: a bit body including one or more blades; a plurality of cutters secured to the one or more blades; a rolling element; and a retainer within a cavity in the bit body, the retainer receiving the rolling element to rotatably secure the rolling element about a rotational axis of the rolling element, wherein the retainer has an inner arcuate surface that abuts the rolling element, and wherein the retainer has a compliant portion that is compressible responsive to a force from the rolling element on the inner arcuate surface.

Clause B. A rolling element assembly, comprising: a rolling element rotatable about a rotational axis of the rolling element when the rolling element is positioned within a cavity in a bit body of a drill bit; and a compliant retainer extendable within the cavity to receive and rotatably secure the rolling element within the cavity, wherein the compliant retainer comprises an inner arcuate surface, and wherein the compliant retainer is compressible responsive to a force from the rolling element on the inner arcuate surface.

Clause C. A compliant retainer for a rolling element assembly that is configured to be positioned within a cavity in a bit body of a drill bit, the compliant retainer comprising: a rigid base structure formed from a rigid material and having an inner arcuate surface that is complementary to a rolling element of the rolling element assembly; and a cavity formed in the rigid base structure such that a portion of the rigid base structure can be pressed into the cavity, responsive to a force on the inner arcuate surface, to provide compliancy for the compliant retainer.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A drill bit, comprising:

a bit body including one or more blades;

a plurality of cutters secured to the one or more blades;

a rolling element; and a retainer within a cavity in the bit body, the retainer receiving the rolling element to rotatably secure the rolling element about a rotational axis of the rolling element, wherein the retainer has a base structure with an inner arcuate surface that abuts the rolling element, an internal cavity, and a compliant portion that is compressible responsive to a force from the rolling element on the inner arcuate surface, wherein the internal cavity is a closed cavity that is equidistant from inner and outer edges of the base structure and from the inner arcuate surface and an outer arcuate surface of the base structure.

2. The drill bit of claim 1, wherein the internal cavity is filled with an elastomeric material.

3. The drill bit of claim 2, further comprising a plurality of voids in the elastomeric material.

4. The drill bit of claim 1, further comprising at least one additional internal cavity in the base structure.

5. The drill bit of claim 4, wherein at least one of the internal cavity and the at least one additional internal cavity is filled with a material having a modulus of elasticity that is different from a modulus of elasticity of the base structure.

6. The drill bit of claim 4, wherein all of the internal cavities are filled with same material.

7. The drill bit of claim 1, wherein the base structure comprises an inner edge wall that is incompressible.

8. The drill bit of claim 1, wherein the compliant portion of the retainer is configured such that the force from the rolling element on the inner arcuate surface causes a portion of the inner arcuate surface to move toward an opposing outer arcuate surface, thereby decreasing the thickness of the compliant portion.

9. The drill bit of claim 1, wherein the retainer comprises a location-dependent compressibility.

10. The drill bit of claim 1, wherein the cavity comprises a retainer slot, and wherein, when the retainer is disposed in the retainer slot, the retainer and an inner surface of the cavity cooperatively encircle more than 180 degrees but less than 360 degrees of a circumference of the rolling element such that a full axial width of a portion of the rolling element is exposed outside the cavity.

11. The drill bit of claim 10, wherein the portion of the rolling element that is exposed outside the cavity is adjustable based on a compressive state of the compliant portion of the retainer.

12. The drill bit of claim 1, further comprising an attachment structure that holds the retainer in position in a retainer slot in the cavity, wherein the compliant portion of the retainer is compliant to absorb vibrations of the rolling element before the vibrations reach the attachment structure.

13. A drill bit, comprising:

a bit body including one or more blades;

a plurality of cutters secured to the one or more blades:

a rolling element;

a retainer within a cavity in the bit body, the retainer receiving the rolling element to rotatably secure the rolling element about a rotational axis of the rolling element, wherein the retainer has a base structure with an inner arcuate surface that abuts the rolling element, an internal cavity, and a compliant portion that is compressible responsive to a force from the rolling element on the inner arcuate surface; and at least one additional internal cavity in the base structure, wherein at least one of the internal cavity and the at least one additional internal cavity is filled with a material having a modulus of elasticity that is different from a modulus of elasticity of the base structure;

wherein the internal cavity is filled with the material and the at least one additional internal cavity is filled with a different material having a modulus of elasticity that is different from the modulus of elasticity of the material.

14. The drill bit of claim 13, wherein the internal cavity is filled with an elastomeric material.

15. The drill bit of claim 14, further comprising a plurality of voids in the elastomeric material.

16. The drill bit of claim 13, further comprising at least one additional internal cavity in the base structure.

17. The drill bit of claim 16, wherein at least one of the internal cavity and the at least one additional internal cavity is filled with a material having a modulus of elasticity that is different from a modulus of elasticity of the base structure.

18. The drill bit of claim 16, wherein all of the internal cavities are filled with same material.

19. The drill bit of claim 13, wherein the retainer comprises a location-dependent compressibility.

* * * * *